US010801811B2

(12) United States Patent
Hovsepian

(10) Patent No.: US 10,801,811 B2
(45) Date of Patent: Oct. 13, 2020

(54) FLASHLIGHT ATTACHMENT FOR FIREARM LASER SIGHT

(71) Applicant: Richard George Hovsepian, Alachua, FL (US)

(72) Inventor: Richard George Hovsepian, Alachua, FL (US)

( * ) Notice: Subject to any disclaimer, the term of this patent is extended or adjusted under 35 U.S.C. 154(b) by 0 days.

(21) Appl. No.: 16/439,945

(22) Filed: Jun. 13, 2019

(65) Prior Publication Data

US 2020/0033092 A1 Jan. 30, 2020

Related U.S. Application Data

(60) Provisional application No. 62/703,032, filed on Jul. 25, 2018.

(51) Int. Cl.

| | |
|---|---|
| ***F41G 1/34*** | (2006.01) |
| ***F41G 1/35*** | (2006.01) |
| ***F42B 3/113*** | (2006.01) |

(52) U.S. Cl.

CPC ..... *F41G 1/35* (2013.01); *F42B 3/113* (2013.01); *F41G 1/34* (2013.01); *F41G 1/345* (2013.01)

(58) Field of Classification Search

CPC ... F41G 1/34; F41G 1/345; F41G 1/35; F41G 1/36; F42B 3/113

See application file for complete search history.

(56) References Cited

U.S. PATENT DOCUMENTS

2005/0252065 A1* 11/2005 Scherpf ..... F41G 1/345 42/123
2011/0058362 A1* 3/2011 Sun ..... F41G 1/35 362/157
2015/0241169 A1* 8/2015 Cheng ..... F41G 1/34 42/114

* cited by examiner

*Primary Examiner* — Y M. Quach Lee
(74) *Attorney, Agent, or Firm* — Sven W Hanson

(57) ABSTRACT

An electrically powered device is secured to the exterior surface of a handgun-mounted laser sight. The powered device includes a housing with two parallel arms that receive between them the laser sight housing. An plug on the inside surface of one arm enters and engages with a battery cavity in the housing to create a physical interference and connection between the powered device and the laser sight device housing. The plug includes electrical circuit elements to electrically connect the powered device to a battery within the cavity. The powered device is powered by connection with a battery contained in the laser sight device to which it is mounted.

3 Claims, 4 Drawing Sheets

FLASHLIGHT ATTACHMENT FOR FIREARM LASER SIGHT

BACKGROUND

The present invention pertains to mountings for illuminating light devices to be secured to handgun accessories, particularly battery-powered laser sights on handguns. Triggerguard-mounted firearm lasers and illumination lights are typically purchased as either one of: a laser-only product, an illumination light-only product or an integrated laser-light combined product. The invention allows a user to incorporate an illumination light to a handgun-mounted laser sight device or install both a laser device and an illumination light as a combined device at one time. At different situations, the trimness of a handgun mounted laser alone is preferred and at other situations exists a greater advantage of a illumination light in combination with a laser device. It is desirable to be able to combine a separate illumination light to a handgun mounted laser sight on an as-needed basis. The invention provides adds a stackable light that can easily be attached to an existing laser sight device.

SUMMARY OF THE INVENTION

The invention provides an illumination device not dependent on an internal power source and that may be secured to a handgun-mounted laser sight device in a manner to access the battery power source of the laser sight device and in this way enabling a more compact combined function device.

The invention includes an electrically powered device that may be secured to the exterior surface of a handgun-mounted laser sight. The powered device includes a housing with two parallel arms that receive between them the laser sight housing. A plug on the inside surface of one arm enters and engages with a battery cavity in the housing to create a physical interference and physical connection between the powered device and the laser sight device housing. The plug may include electrical circuit elements to electrically connect the powered device to a battery within the cavity.

The invention includes an electrically powered device that is handgun-mountable and that does not contain an electrical power source, but is operable when secured to a handgun-mounted laser sight device having an external battery cavity with a removable door.

The invention includes also a laser sight device having an external battery cavity and combined with a powered device that is mountable to the laser sight device while connecting to a battery within the laser sight device cavity.

In various different configurations, the powered device may be alternatively an illumination device, a laser sight, or one of other electrically powered devices.

Embodiments and configurations of the invention are described in the below description and accompanying figures. The intended scope of the invention is defined by the claims.

DETAILS OF EMBODIMENTS OF THE INVENTION

Figure 1:
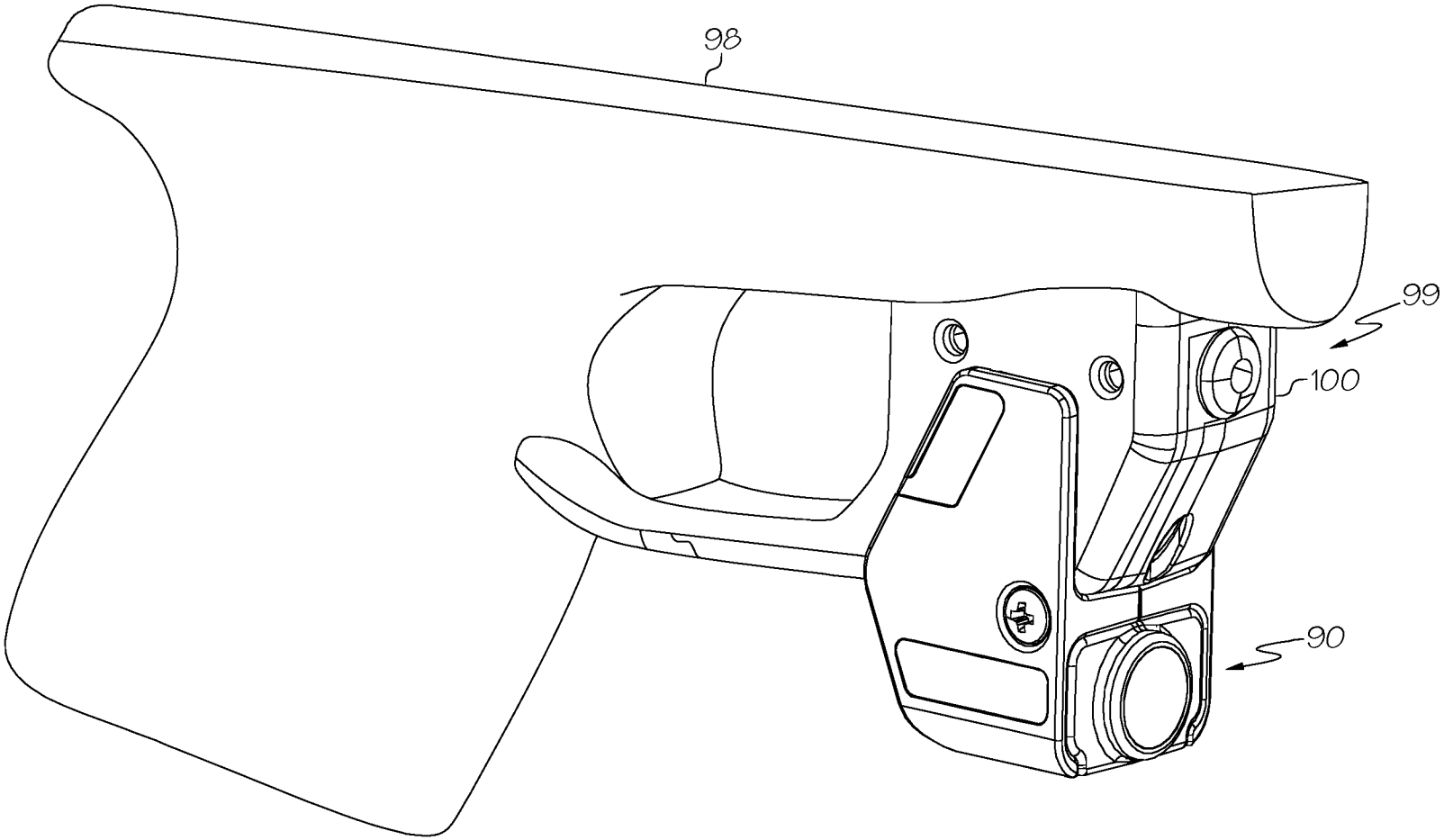
FIG. 1 is an isometric view of an inventive device on a handgun frame mounted laser sight device.
Figure 2:
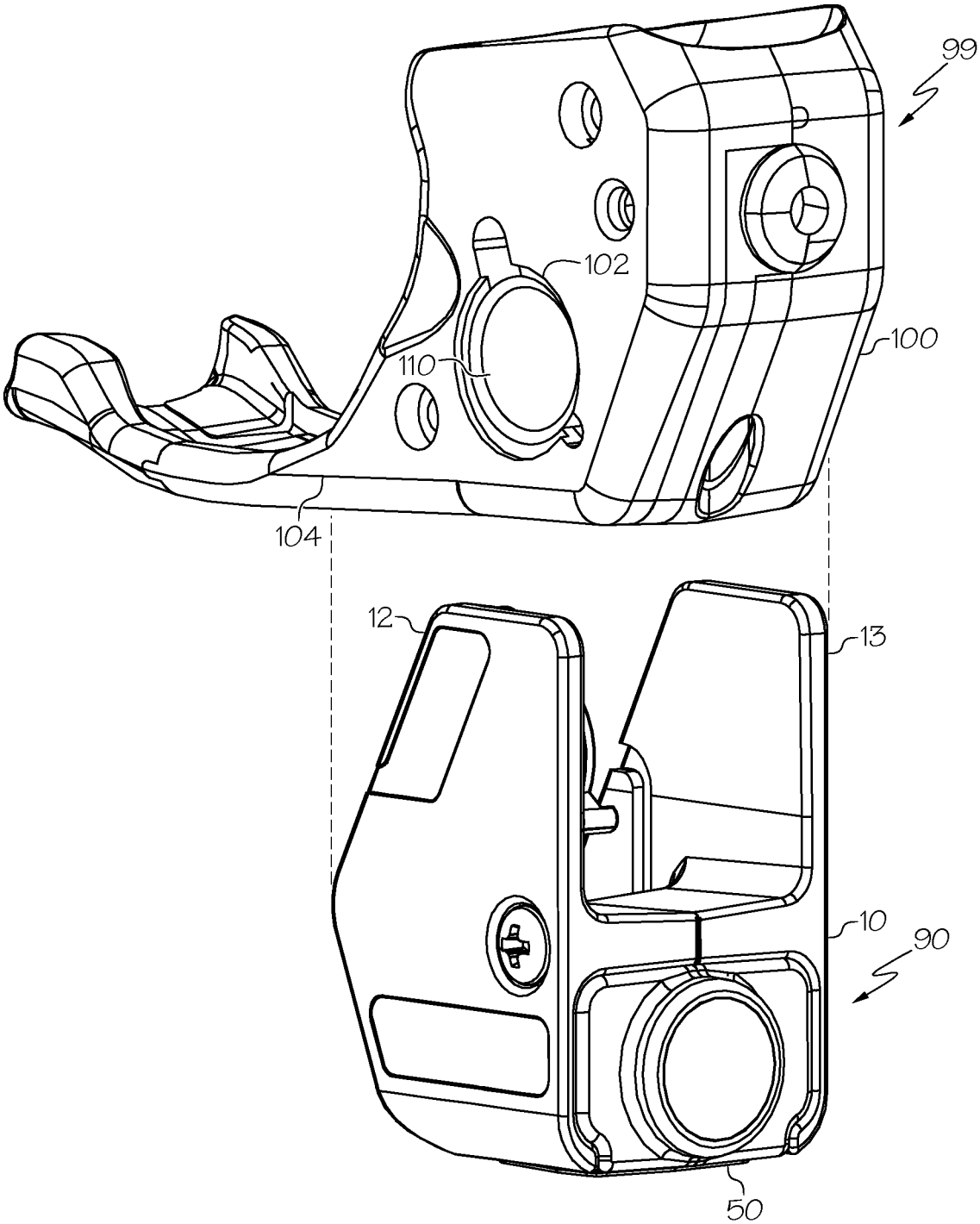
FIG. 2 depicts the device of FIG. 1 separated from the laser sight device.
Figure 3A:
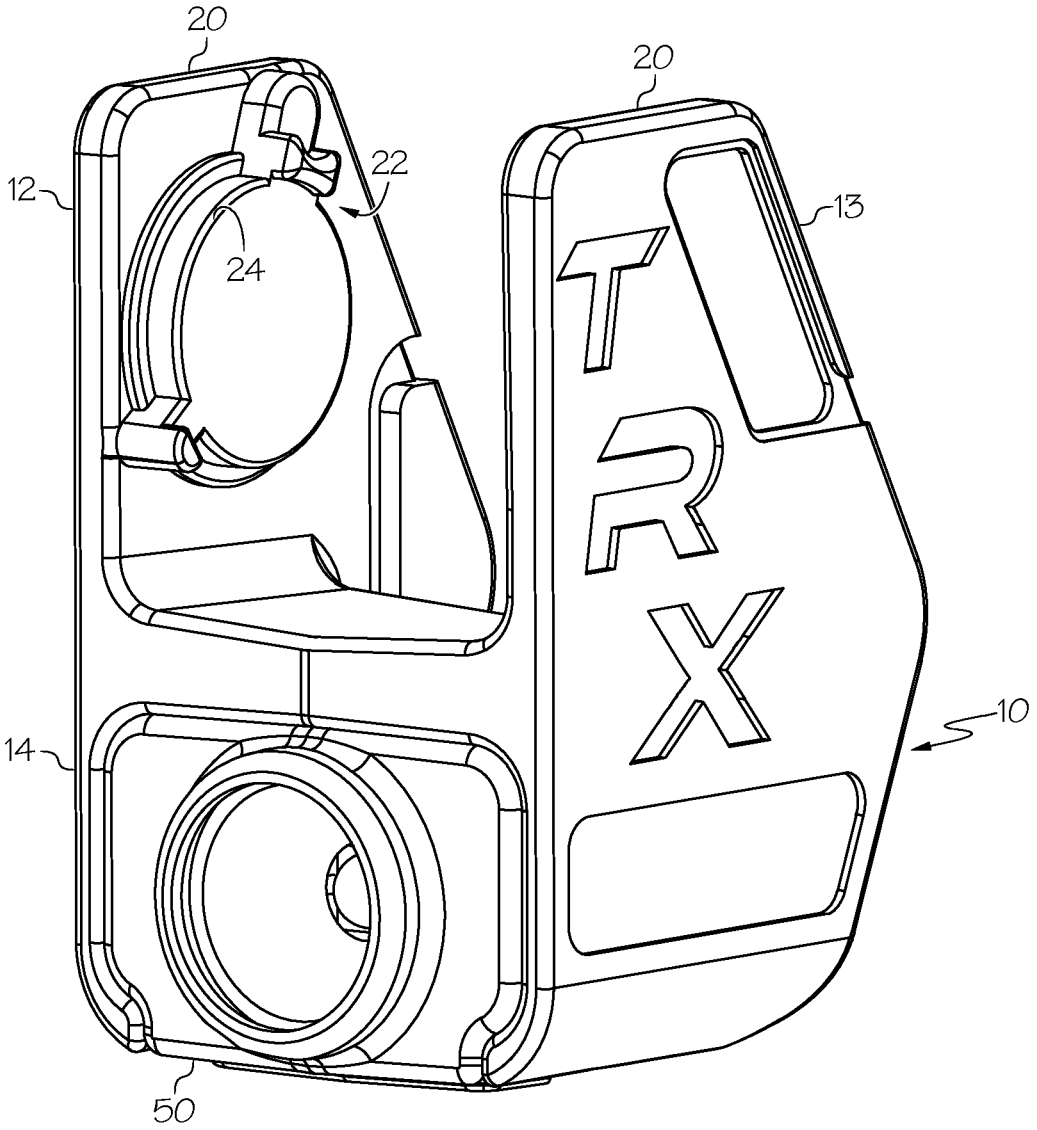
FIGS. 3A and 3B are isometric and front views of the inventive device of FIG. 1.
Figure 3B:
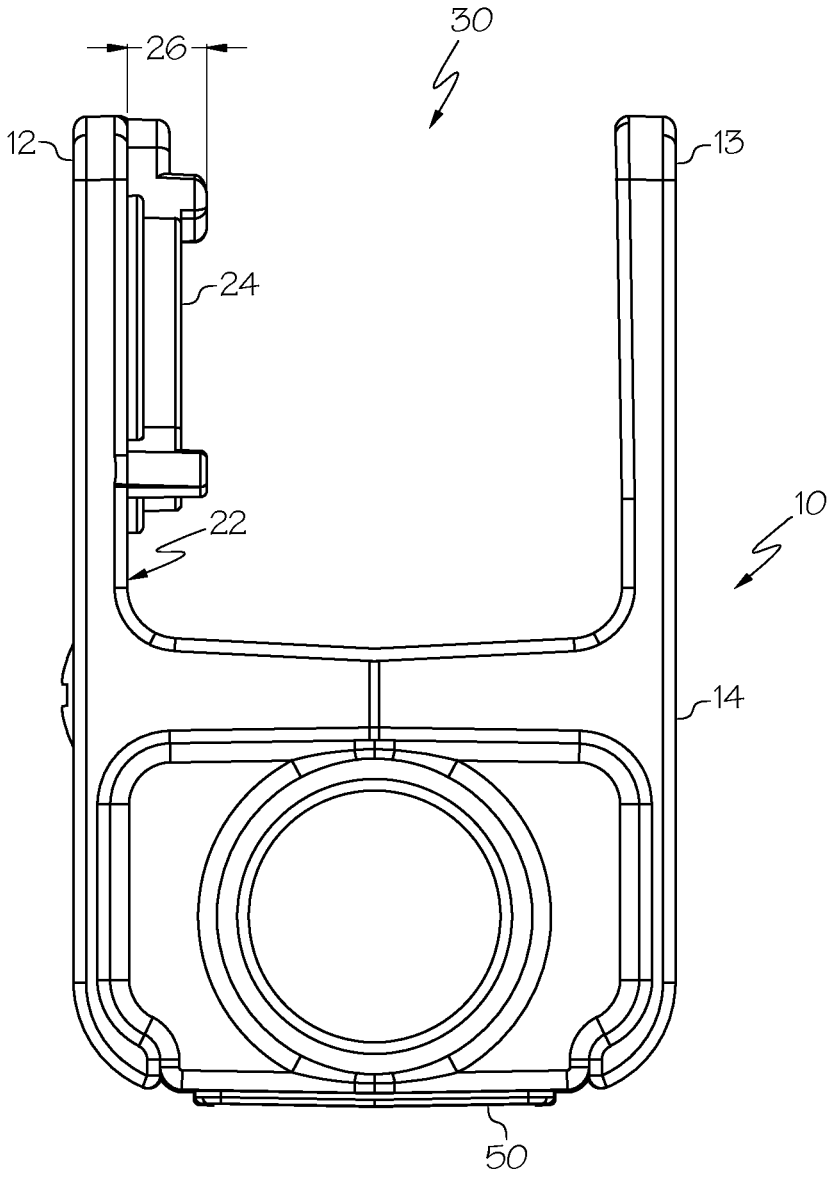

FIGS. 1, 2 and 3A, 3B illustrate an embodiment of the inventive illumination light. Herein, the term "illumination light" is used to indicate any number of light-emitting devices that that are typically used to illuminate a space or objects and the term is used to distinguish the associated device from a laser light device that emits light in a columnated form that is generally not useful for broad illumination of space or objects. An illumination light may be identified by an angular emission of illumination much greater than laser devices.

In the figures, a conventional laser sight device 99 is shown on a conventional handgun frame 98 and also standing alone, unattached. The laser sight device 99 includes a rigid housing 100 that contains a conventional laser light emitting device and power and control elements (not shown). It is common that such conventional laser devices are battery-powered and contain rechargeable or replaceable batteries. For battery replacement or maintenance purposes, the housing 100 includes an open battery cavity or well 102 located in an exterior sidewall 104 of the housing 100 and accessible directly from outside the housing 100. The location of the cavity 102, accessible on the exterior, is critical for access. The housing 100 includes a second, opposing sidewall (not shown) that is effectively parallel to the exterior sidewall 104.

The battery cavity 102 in the configuration shown is circular in shape and contains non-symmetrically arranged perimeter gaps or cutouts. This non-symmetrically shape may be an incidental result of other requirements of these aspects of the battery cavity 102. An associated door element (not shown) may include related elements that fit within the gaps so that the door may close the doorway during alternative conventional use without the inventive device.

The inventive accessory-mounted device 90 illustrated includes two major components: a housing 10 and an associated illumination device 50. The illumination device 50 preferably uses a LED (light emitting diode) as a powered light source, although other similar devices may be alternatively used. The illumination device 50 may be a separate component secured to or captured by the housing or may be integrated into the housing 10. For these purposes, the housing 10 is preferably formed of separable (left and right side) portions to allow for insertion and capture of the illumination device 50 within.

The housing 10 includes two rigid arms 12,13 which extend mutually parallel from the housing body 14 to respective distal ends 20. Each of the arms 12, 13 includes a respective facing surface 22. The respecting arm facing surfaces 22 being mutually opposing and defining between them a U-gap channel 30.

On the facing surface 22 of one arm 12, between the housing body 14 and the arm distal end 20, is a rigid doorplug 24. The doorplug 24 extends rigidly and orthogonally outward from the facing surface 22, into the U-gap channel 30 and toward the other arm 13. The length and separation of the rigid arms 12, 13, the location of the doorplug 24, and dimensional extent outward of the doorplug 24 from the facing surface 22 are together configured such that the housing 14 may be positioned on the laser sight device 99 with the two arms 12, 13 contacting, and parallel to, respective opposing exterial surfaces 104 of the laser sight device 99, with the doorplug 24 received in the battery cavity 102. The doorplug 24 effectively takes the place, physically, of the battery cavity door that would otherwise close the battery cavity.

The physical interference of the matching doorplug 24 with the perimeter gaps and cutouts of the battery cavity 102 prevent associated rotation of the housing body 14 relative to the laser sight device 99. The doorplug 24 also prevents translational movement of the housing in the plane of the facing surface 22. Effectively, when the arms 12, 13 are held by the rigidity of the housing body 14 against the laser sight device 99, the housing body 14 is rigidly connected to the laser sight device 99.

For this purpose, sufficient interference dimension must exist between between the battery cavity 102 and the doorplug 24. The depth (inward from the exterior sidewall exterial surface) of the doorway opening 102 and the corresponding height dimension 26 of the doorplug 24 from the facing surface 22 must be no less than 1.5 mm (millimeters); which requirement will be incidentially satisfied by most practical doorplug 24 and battery cavity 102. As well, to prevent rotation as desire, the geometry of the interfering elements, the mating cavity 102 and the doorplug 24, cannot be entirely circular in shape. In the illustrated configuration, the battery well is principally circular, but the battery cavity 102 perimeter includes non-symmetrically arranged cutouts which alter the overall effective shape fo the battery cavity 102 with respect to its coordination with the doorplug 24. The doorplug 24 likewise includes perimeter features that result in a noncircular shape. To summarize, the mating elements of the battery cavity 102 and doorplug 24 must have a perimeter shape that is noncircular and defines elements that interfere with and prevent relative rotation of the elements.

The required height dimension 26 of the door plug 24 is somewhat dependent on the type of material used for both the doorplug 24 and the corresponding surfaces in the laser sight device. If both the parts are made from metallic material, the corresponding minimum height dimension 26 has been found to be 1.5 mm (millimeters) to prevent rotation. Translational failure is likely prevented in any configuration that is secure in rotation. As plastics are generally less strong than metals, for a laser sight device or doorplug 24 of rigid plastic material, a greater minimum height dimension 26 of about 2.5 mm is required. Any cross-sectional shape of the doorplug 24 that is non-circular can be enabled, but if circular, then a single tab of at least 1.5 mm width and 1.5 mm depth for metal parts and 2.5 mm width and 2.5 mm depth for plastic parts will be necessary to prevent rotation. Two or more such tabs are recommended. Both the material and the dimensions of the arms 12, 13 must be chosen to result in an arm stiffness sufficient to maintain the doorplug 24 within the cavity 102 during potential applied forces and torsions.

A two-part construction of the housing body 14 is preferred in part to enable assembly and attachment of the accessory mounted device 90 to the laser sight device with the interference discussed respecting the doorplug 24.

It is anticipated that the laser sight device 99 will, in some configurations, contain an accessible battery 110 used to power the laser sight device 99. The doorplug 24 includes electrical circuit elements, such as surface contacts and traces (not shown), configured to enter the exterior sidewall 104 with the doorplug 24 and contact and connect, directly or indirectly, with the battery terminals. Electrical conduction elements in the doorplug 24 and the housing 10 electrically connect the powerable components, including the illumination device 50, with the battery. In this way, the illumination device 50 may be operated via the power carried by the laser sight device 99. In this way also, the invention includes an electrically powered device that is handgun mountable that does not contain a electrical power source, but is operable on a handgun.

Preferably, the housing 10 includes devices and circuits to enable "passive" switching or operation of the powered device. The term "passive" is meant to indicate switching or operational control of the powered device via actions of the user that are inherent or inevitable in the use of the powered device. Such passive switching includes "touch" switching that results from touch by, without force or pressure, or presence of, the user's fingers when located in locations typical or ordinary in the use of handguns. For example, most preferably, the housing 10 includes one or more touch-sensitive switches on the external surface of the housing 10 in the rearward portions of the housing—reached naturally by a user's index finger when extended in a normal grip of the handgun. Such switching devices will be connected to, or controlling, the power circuit elements described above. Touch sensitive switches may use inductance, conductance, impedence or heat detecting means and devices.

The function of the arms 12, 13 and the doorplug 24 to secure the housing 10 to the laser sight device 99 is enabled independent of the presence of, or operation of, a battery within the laser sight device 99. Therefore, in one alternative configuration of the invention, the "battery cavity" may take the form of a similar structure without the presence or function of a laser sight device battery nor of shared battery power. Such a configuration benefits from the novel structural combination of the housing and powered design on a laser sight device.

In alternative configurations, the accessory-mounted device 90 includes a power source such as an electric battery, or is otherwise connected to an internal power source to enable the powered device. In these configurations, the doorplug 24 may electrically connect with a handgun-mounted laser sight device battery as discussed above or may have no connectivity with another power source. In these configurations, the doorplug 24 engages with a battery cavity, or similar structure, to provide the same physical connection discussed above between the accessory-mounted device and the laser sight.

In further configurations of the invention, the accessory-mounted device may be other powered devices such as cameras, a laser sight device, or any of a variety of other electronic devices.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative.

Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to elements in the singular, for example, using the articles "a," "an," "the" or "said," is not to be construed as limiting the element to the singular.

The invention claimed is:

1. A handgun accessory for use with a battery-powered handgun laser sight device having an external sidewall cavity, the accessory comprising:

a rigid housing including two mutually parallel arms, the parallel arms located spaced apart to define a channel gap between them and configured to receive in the channel gap the laser sight device;

one of the arms having a plug configured to be received into the cavity such that relative rotation is prevented between the housing and the laser sight device;

an electrically powered device secured in the housing and wherein:

the plug is configured to connect to a battery located in the cavity;

such that the powered device may operate by power from a battery within the laser sight device.

2. A handgun accessory, according to claim 1 and wherein the powered device comprises an illumination device.

3. A handgun accessory comprising:

a handgun-mountable laser sight device having a battery cavity and a battery within the battery cavity;

an illumination device without any internal power source;

the illumination device having two rigid arms, the laser sight device located between the two arms;

the two arms including a plug located within, and engaged with, the battery cavity thereby securing the illumination device to the laser sight device;

the illumination device powered by the battery.

* * * * *